United States Patent [19]

Stevens

[11] 4,387,928

[45] Jun. 14, 1983

[54] TUNNEL EXCAVATOR

[75] Inventor: Richard W. Stevens, Milwaukee, Wis.

[73] Assignee: Milwaukee Boiler Manufacturing Co., Milwaukee, Wis.

[21] Appl. No.: 248,328

[22] Filed: Mar. 27, 1981

[51] Int. Cl.[3] ..... E21D 9/08

[52] U.S. Cl. ..... 299/33; 299/67

[58] Field of Search ..... 299/33, 67; 405/141

[56] References Cited

U.S. PATENT DOCUMENTS

| | | | |
|---|---|---|---|
| 2,606,013 | 8/1952 | Acker, Jr. | 214/138 R X |
| 2,652,640 | 9/1953 | Schield | 214/138 X |
| 3,404,920 | 10/1968 | Tabor | 299/67 X |
| 3,556,599 | 1/1971 | Fikse | 299/67 X |
| 3,612,609 | 10/1971 | Reuls | 299/67 X |
| 3,907,093 | 9/1975 | Skibo | 198/511 |
| 3,958,831 | 5/1976 | Nakashima et al. | 299/70 X |
| 4,190,294 | 2/1980 | Fikse | 299/67 X |
| 4,203,626 | 5/1980 | Hamburger | 299/33 |
| 4,349,230 | 9/1982 | Hamburger et al. | 299/67 X |

FOREIGN PATENT DOCUMENTS 2248785 4/1974 Fed. Rep. of Germany ..... 299/71

*Primary Examiner*—Ernest R. Purser

*Attorney, Agent, or Firm*—Andrus, Sceales, Starke & Sawall

[57] ABSTRACT

An excavator has a support mountable within the hull of a tunneling shield. A swing frame is rotatably journalled in the support about an axis canted with respect to the axis of the tunnel to permit effective application of an excavating implement. A link has one end pivotally mounted on the swing frame for moving the other end so that it has a component of movement toward and away from the work face of the tunnel. A dipper arm is pivotally mounted between the link and the excavating implement. A hydraulic drive means rotates the swing frame and pivots the link, dipper arm, and excavating implement.

14 Claims, 4 Drawing Figures

FIG.3
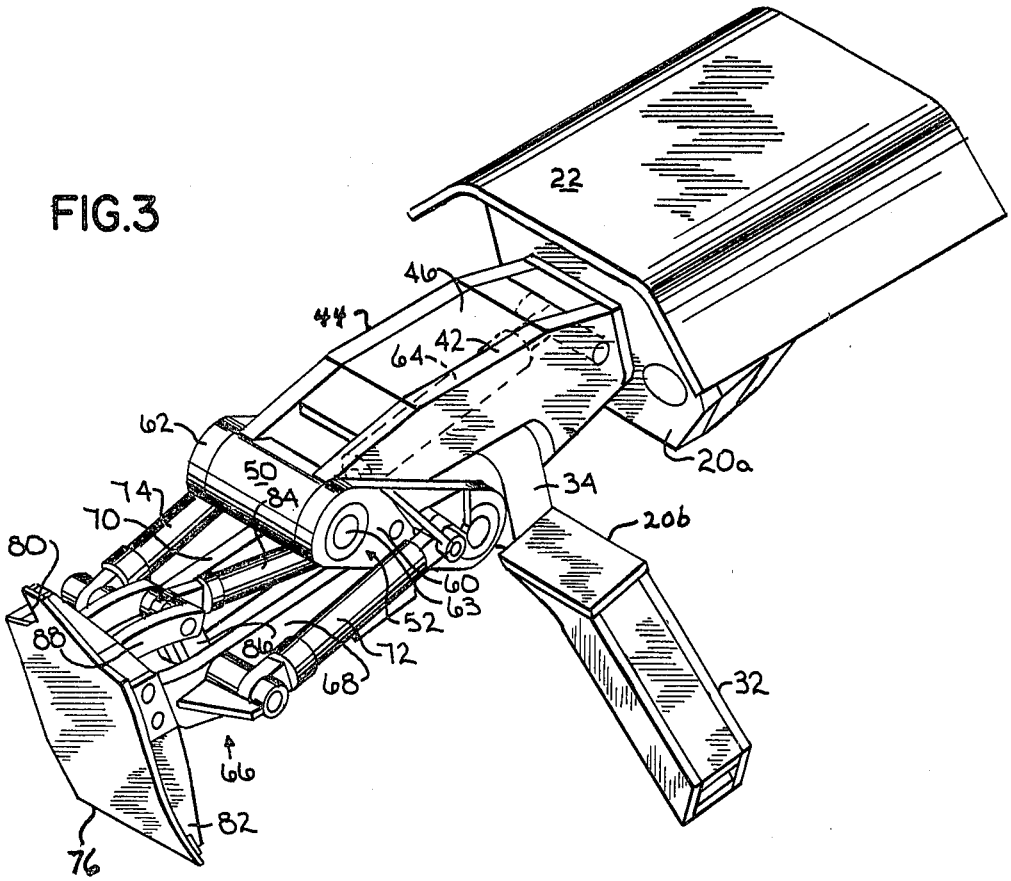
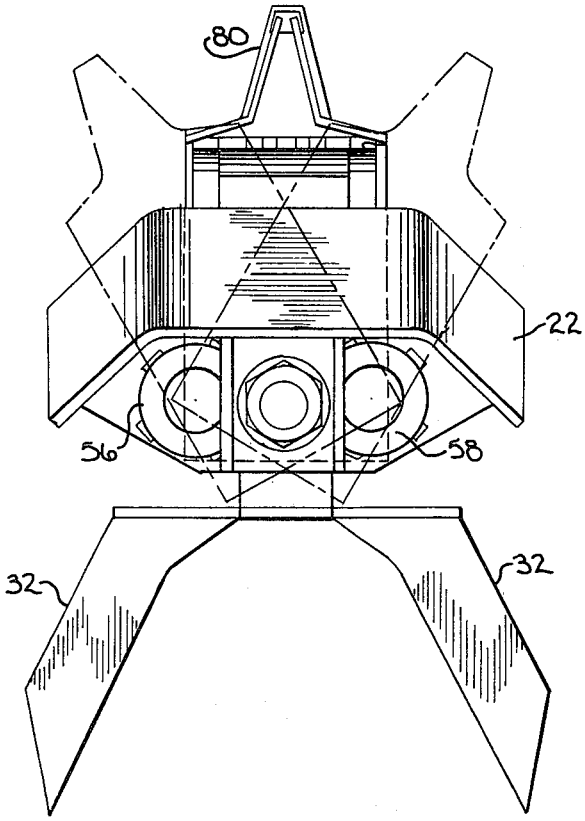
FIG.4

TUNNEL EXCAVATOR

The present invention relates to an improved excavator suitable for use in a tunneling shield to excavate the work face of a tunnel.

Tunneling shields used to drive tunnels through the ground include a hull that is placed ahead of the tunnel liner in the bore of the tunnel. A movable hood, generally comprising a plurality of movable segments mounted along the upper portion of the shield, is extended into the ground. The work face of the tunnel beneath these segments may then be safely excavated. The excavated soil is removed through the hull and tunnel liner. When the work face has been completely loosened and excavated, the hull is advanced and a new section of tunnel liner inserted along the tunnel bore in the space formerly occupied by the hull.

The rapidity with which the tunnel may be bored depends in great measure on the effectiveness of excavating means employed in conjunction with the tunneling shield to remove the soil. While many types of excavating apparatus have been devised for use in tunneling equipment, they have typically been deficient in one or more of the following respects. Some such apparatus fails to effectively apply the excavating implement to the work face of the tunnel as by not fully providing the necessary excavating action or leaving areas that must be excavated by hand. Or, such apparatus may be unsuited to the close confines of the tunneling shield, hampering access by workmen to the face of the tunnel and exhibiting other shortcomings.

It is, therefore, the object of the present invention to provide an improved excavator suitable for use in a tunneling shield and capable of providing the necessary excavating action in all desired areas of the work face of the tunnel in a simple and economical manner.

Briefly, the present invention provides an excavator having a support means mountable on the hull of the tunneling shield for positioning the excavator in the shield. A swing frame is rotatably journalled in the support means about a fixed axis permitting application of an excavating implement to the work face at arcuately spaced regions. The axis is canted with respect to the axis of the tunnel to permit effective application of the excavating implement. A link has one end pivotally mounted on the swing frame for moving the other end so that it has a component of movement toward and away from the work face of the tunnel. The link permits the excavator to be placed rearwardly of the work face facilitating movement of workmen about the excavator and work face. A dipper arm is pivotally mounted on the link and the excavating implement. A hydraulic drive means rotates the swing frame and pivots the link, dipper arm, and excavating implement.

The invention will be further explained with the aid of the drawing containing the following four figures and showing additional details and features of the invention.

FIG. 3 is a perspective view showing the improved excavator of the present invention.

FIG. 4 is a rear view of the excavator of the present invention taken along the line 4—4 in FIG. 1.

Figure 1:
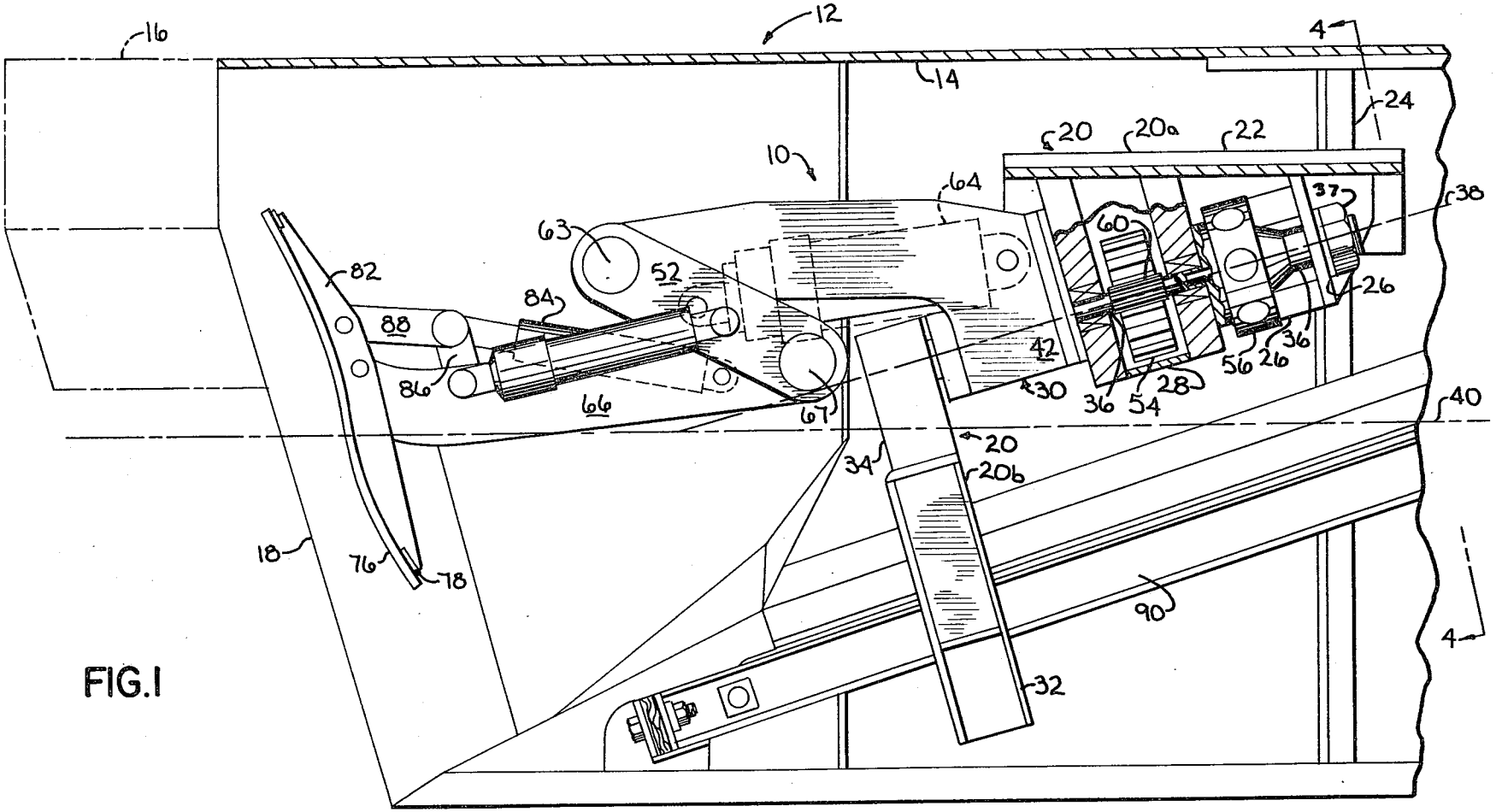
FIG. 1 is an elevational view showing the improved excavator of the present invention with the elements in a first position. The figure also shows the associated tunneling shield.

as shown in FIG. 1, excavator 10 of the present invention is suitable for use in tunneling shield 12. Tunneling shield 12 may be any one of a wide variety of shields, including that shown in U.S. Pat. No. 3,581,507 assigned to the same assignee as the application. Tunneling shield 12 includes hull 14 that lies along the bore of the tunnel. Hull 14 may have a generally horseshoe shaped cross-sectional configuration. Hull 14 has one or more hood segments 16 mounted on its forward edge 18. The lower portion of forward edge 18 is cut away so that it lies along the workface of the tunnel which slants rearwardly due to typical subsidence characteristics of the ground. Hood segments 16 are extendable into the work face of the tunnel, as shown in phantom in FIGS. 1 and 2 to support the overburden while excavation takes place at the work face beneath the segments.

Excavator 10 is mounted in tunneling shield 12 by support means 20. Support means 20 includes upper support portion 20*a* and lower support portion 20*b*. As shown most clearly in FIGS. 1 and 3, upper support portion 20*a* includes plate 22 suitable for joinder to tunneling shield 12, as at the frames of the latter, one of which is shown, in FIG. 1 by 24. Plate 22 contains retaining plate 26 and gear housing 28 for swing frame 30, further described below.

Lower support portion 20*b* includes legs 32, the lower ends of which are fixed to hull 12 and the upper ends of which are fixed to front bearing 34 for swing frame 30.

Shaft 36, fastened to swing frame 30 has one end mounted in front bearing 34 and extends through bearings in gear housing 28 so that the swing frame lies between the bearing 34 and the gear housing. The other end of shaft 36 is retained in plate 26 by nut 37 to enable the plate to absorb axial loading of shaft 36. Swing frame 30 rotates about a slanting axis exteding from front bearing 34 indicated by line 38 in FIG. 1. It will be noted that the axis of rotation 38 of shaft 36 lies at an angle to the axis 40 of tunneling shield 12. It has been found advantageous to the orient excavator 10 so that axis 38 lies normal to the slanting portions of edge 18, i.e. normal to the typical work face of the tunnel. This provides efficient and effective application of the excavating implement to the work face. Axis of rotation 38 may typically be at an angle of approximately 15° to 25° to the axis 40 of tunneling shield 12.

Figure 2:
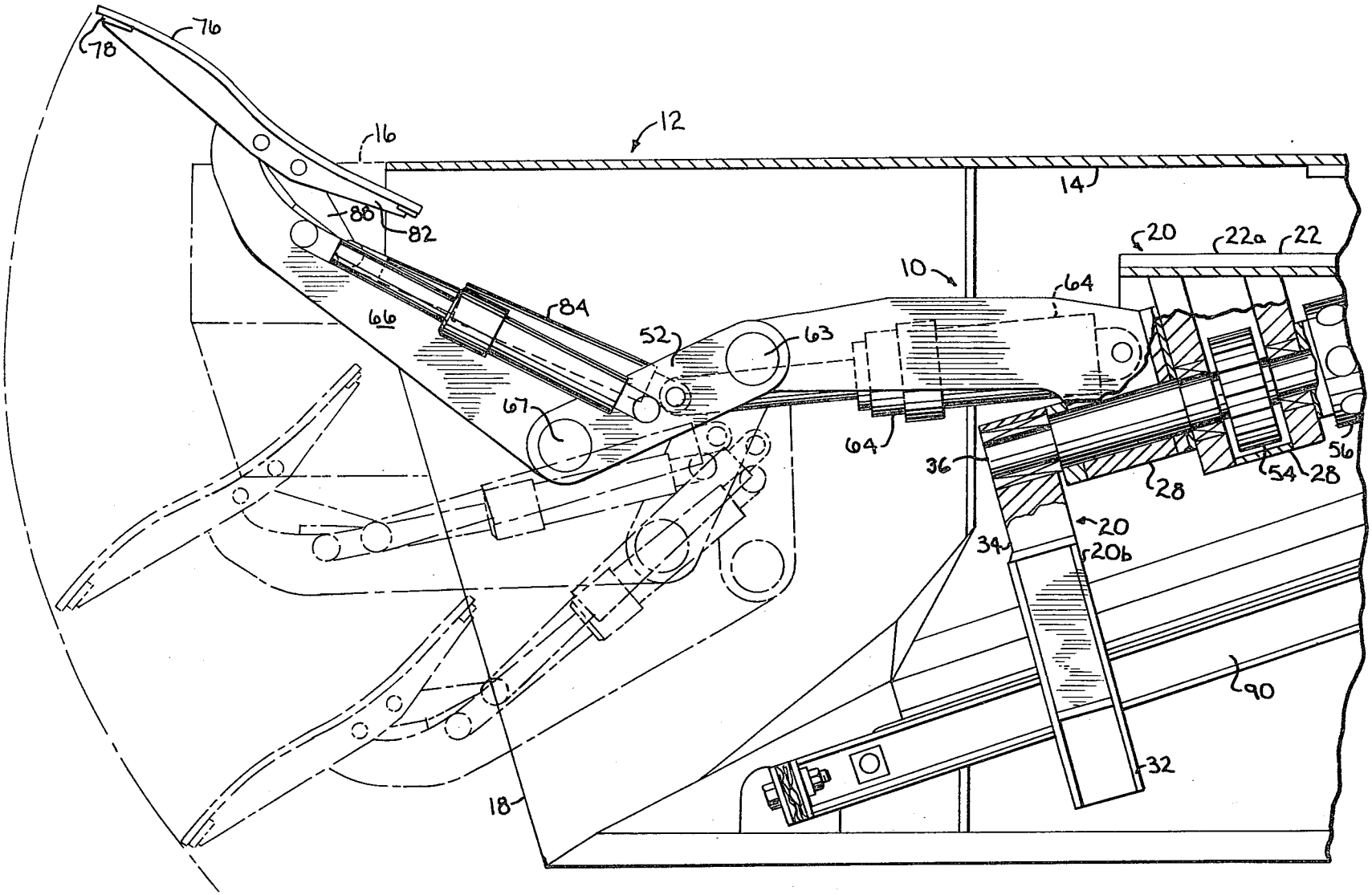
FIG. 2 is an elevational view similar to FIG. 1 showing the elements in a second operating position and showing other operating positions of the elements in phantom.

As shown in FIG. 3, swing frame 30 includes a pair of spaced frames 42 and 44 extending therefrom. With axis 38 slanted as shown in FIG. 1, the extension of frames 42 and 44 typically lies generally parallel to the axis 40 of tunneling shield 12, as shown in FIGS. 1 and 2. Plate 46 may reinforce frames 42 and 44. Frames 42 and 44 end in journal 50 for link 52, hereinafter described.

Gear 54, mounted on shaft 36, is located in gear housing 28 of upper support portion 20*a*, as shown in FIG. 2. As shown in FIG. 4, a pair of hydraulic motors 56 and 58 are mounted on upper support portion 20*a* to drive pinion gears engaging gear 54 to rotate swing frame 30 on axis 38. One such pinion gear is shown in FIG. 2 by 60. Hydraulic motors 56 and 58 may be located in diametrically opposite positions to provide more balanced loading on gear 54 and upper support portion 20*a*. Front bearing 34 is so formed as to permit swing frame 30 to rotate through the desired arc. This is typically 90° on either side of a vertically centered position for a total arcuate movement of 180°.

Link 52 is comprised of a pair of side plates 60 and 62, one end of each of which is coupled to pivot pin 63 mounted in journal 50 of swing frame 30. Hydraulic cylinder 64 is connected intermediate swing frame 30 and link 52. Operation of hydraulic cylinder 64 arcuately swings the other end of link 52 from the position shown in FIG. 1, through the various intermediate positions shown in phantom in FIG. 2, to the position shown in solid lines in FIG. 2. This is an arc of approximately 130°. The arcuate movement of the other end of link 52 provides a component of motion toward and away from the work face of the tunnel.

Dipper arm 66 is pivotally mounted in the other ends of side plates 60 and 62 of link 52 by pivot pin 67. Dipper arms 66 may comprise a pair of arms 68 and 70 affixed inside side plates 60 and 62, respectively. A pair of hyraulic cylinders 72 and 74 extending between dipper arm 66 and link 52 moves dipper arm 66 relative to link 52.

Excavating implement 76 is pivotally mounted on the end of a dipper arm 66. Excavating implement 76 may comprise a bent plate having a hardened work strip 78 on one edge and a projection 80 on the other end thereof. Flanges 82 on the sides of excavating implement 76 provides a means for mounting the excavating implement on dipper arm 66. Hydraulic cylinder 84, mounted on dipper arm 66 operates excavating implement 76 through linkage 86–88.

Hydraulic cylinders 64, 72, 74, and 84, and hydraulic motors 56 and 58 may be energized by a hydraulic control system of conventional construction.

In operation, tunneling shield 12 is moved into abutment with the work face of the tunnel with segments 16 retracted. Segments 16 are thereafter driven into the work face of the tunnel, as shown in phantom in FIG. 1. Excavator 10 is operated to apply excavating implement 76 to the work face of the tunnel. For this purpose, swing frame 30, link 52, dipper arm 66, and excavating implement 76 are coordinately moved. Link 52 is pivoted on swing frame 30 to move dipper arm 66 and excavating implement 76 toward the work face. Dipper arm 66 and excavating implement 76 are typically moved to move excavating implement 76 radially across the work face of the tunnel to dislodge material. Swing frame 30 may be rotated about axis 38 to index excavator 10 about the work face of the tunnel. By these movements, excavating implement 76 is effectively applied to all necessary portions of the work face. To hoe away the accumulated material, dipper arm 66 is lowered and either or both of link 52 and excavating implement 76 moved to pull the material from the work face. Conveyor 90 may be provided to receive and remove the material.

When the work face has been excavated to the extremity of the hood segments, excavator 10 is retracted to a position resembling that shown in FIG. 1. Tunneling shield 12 is moved forward as hood segments 16 are slid rearwardly to a position along the tunneling shield. A section of tunnel liner is inserted behind the shield. Hood segments are again extended to continue the boring of the tunnel.

The extension of excavator 10 provided by link 52 permits support means 20 and swing frame 30 to be placed well back from the work face, thereby permitting easy access to the excavator and work face. It also permits excavating implement 76 to extend into, and preferably beyond, the volume occurring beneath extended hood segments 16.

I claim:

1. An excavator for excavating the work face of a tunnel, said excavator being suitable for use in a tunneling shield having a hull locatable in the tunnel, said excavator comprising:

support means mountable on said hull for positioning the excavator therein;

an excavating implement appliable to the work face of the tunnel;

a frame having a rearward end mounted on said support means, said frame having portions extending toward the work face of the tunnel, said portions being spaced from, but lying generally parallel to, the axis of the tunnel and terminating in a forward end of said frame;

a link having a first end pivotally mounted on the forward end of said frame, said link being pivotable between first and second positions, in said first position a second end of said link lies adjacent said frame member portions intermediate said forward and rearward ends of said frame and between said frame member portion and the tunnel axis, in said second position said second end of said link extends in front of said forward end of said frame;

a dipper arm having one end pivotally mounted on said second end of said link and the other end pivotally mounting said excavating implement; and drive means for pivoting said link, dipper arm, and excavating implement.

2. The excavator according to claim 1 wherein said frame is rotatably journalled in said support means to comprise a swing frame, said swing frame being rotatably journalled about an axis permitting application of said excavating implement to the work face at arcuately spaced regions.

3. The excavator according to claim 2 wherein said swing frame is mounted on said support means for rotation about an axis diverging from the axis from the tunnel at an angle less than 90°.

4. The excavator according to claim 3 wherein the work face is usually canted with respect to a vertical plane and wherein said swing frame is mounted on said support means for rotation about an axis lying generally normal to the usual work face.

5. The excavator according to claim 3 wherein said swing frame axis diverges from the tunnel axis in a direction away from the work face by an angle of approximately 15° to 25°.

6. The excavator according to claim 2 wherein said swing frame is rotatable through an arc of approximately 180°.

7. The excavator according to claim 2 wherein said drive means includes hydraulic motor means for rotating said swing frame.

8. The excavator according to claim 2 wherein said drive means includes a gear mounted on said swing frame and at least one motor means coupled to said gear for rotating same.

9. The excavator according to claim 8 wherein said drive means includes a pair of motors coupled to said gear for rotating said same.

10. The excavator according to claim 2 wherein said support means comprises a forward support element and a rear support element, wherein said forward support element supports said swing frame from beneath and said rear support element supports said swing frame from above.

11. The excavator according to claim 1 wherein said link pivots through an angle of approximately 130°.

12. The excavator according to claim 1 wherein said drive means includes hydraulic cylinders for pivoting said link, dipper arm, and excavating implement.

13. The excavator according to claim 1 having conveyor means operatively associated therewith for carrying away material removed from the work face of the tunnel.

14. The excavator according to claim 1 wherein said support means comprises a pair of spaced support elements supporting said frame.

* * * * *